US005335000A

United States Patent [19]

Stevens

[11] Patent Number: 5,335,000

[45] Date of Patent: Aug. 2, 1994

[54] INK VAPOR AEROSOL PEN FOR PEN PLOTTERS

[75] Inventor: Wayne R. Stevens, Downey, Calif.

[73] Assignee: CalComp Inc., Anaheim, Calif.

[21] Appl. No.: 925,603

[22] Filed: Aug. 4, 1992

[51] Int. Cl.[5] ..... B41J 2/11; B41J 2/18

[52] U.S. Cl. ..... 347/82; 347/89

[58] Field of Search ..... 346/75, 140

[56] References Cited

U.S. PATENT DOCUMENTS

| | | | |
|---|---|---|---|
| 1,841,452 | 1/1932 | Ranger | 346/75 X |
| 2,100,204 | 11/1937 | Shore | 346/75 X |
| 2,172,539 | 9/1939 | Kimmich | 346/75 X |
| 2,566,443 | 9/1951 | Elmquist | 346/75 |
| 2,573,143 | 10/1951 | Jacob | 346/75 X |
| 4,019,188 | 4/1977 | Hochberg | 346/75 |

*Primary Examiner*—Joseph W. Hartary

*Attorney, Agent, or Firm*—Wm. F. Porter, Jr.; Donald A. Streck

[57] ABSTRACT

In a pen plotter, a plotting system for generating and delivering vaporized ink to an aerosol pen which is designed to deliver a precision, controlled stream of ink to the media surface without having to come into contact with it. This is achieved by vaporizing ink in a chamber and delivering it to an ink vapor aerosol pen through tubing which is designed to absorb and recover any ink vapor droplets that may have condensed therein and thus obstruct the vapor path. The aerosol pen is designed to dispense the ink vapor as a stream which converges to a fine point thereby allowing a precise image to be plotted on the media surface. As with the vapor delivery tubing, the aerosol pen is also designed to absorb and recover condensed ink vapor droplets. An interrupter moved into and out of the ink vapor stream to act as a valve for the stream so as to stop and start marking on the media by the stream. Intercepted ink is recycled back to the holding chamber.

25 Claims, 4 Drawing Sheets

INK VAPOR AEROSOL PEN FOR PEN PLOTTERS

BACKGROUND OF THE INVENTION

The present invention relates to pen plotters, and more particularly, to a system for marking plotting media in a pen plotter wherein vaporized ink is delivered to an aerosol pen which applies the vaporized ink to the plotting media surface in a precision, controlled spray.

In a traditional pen plotter, an ink-containing pen is carried by a pen carriage over the surface of the plotting media. The pen has a plotting tip communicating with the ink contained within the pen which forms the plotting lines on the media when the tip is lowered by the pen carriage into contact with the media. This means of applying plotting lines presents difficulties when dealing with delicate or abrasive plotting media where the tip cannot glide smoothly over the media surface. The plotting tip may bunch or tear delicate media or, if the media is unusually absorbent, ink blotching may occur during momentary pauses of the pen carriage. Also, if the pen tip crosses a recently plotted line, the previously applied ink may still be wet rendering the media especially susceptible to tearing or damage. Abrasive media may damage the tip of the plotting pen causing irregular or oversized plot lines and ultimately requiring premature replacement of plotting pens. When plotting with multiple colors, whether delicate or sturdy plotting media is used, when the plotting tip crosses a previously plotted line of a different color, the pen tip can pick up some of the previously applied ink, smearing it into the present plot line. This is especially true if lighter colors are plotted after darker ones. This tends to foul the tips of the lighter pens, requiring their replacement.

Because ink flows from plotting pens at a constant rate, pen speeds must be maintained at below a maximum rate to prevent inconsistencies and skipping in the plot lines. Thus, plot generation times are constrained by the rate at which ink will consistently flow from the tips of the plotting pens. Moreover, if the plotter is not dynamically re-programmable in the speed of its relative pen movement over the plotting media, the speed must be set to the maximum speed for the slowest pen tip type.

In order for traditional plotters to generate drawings depicting fill-in, gray scale, or shading, areas must be filled in. Filling in the entire area, multiple shade lines or cross-hatching is normally the preferred method. This consumes large amounts of ink, and to plot such features requires numerous, repetitive pen carriage movements, which increases plot generation time.

Wherefore, it is an object of the present invention to provide an effective technique/system for applying ink to a diverse range of plotting media which does not require contact between the ink administering device and the plotting surface, thus alleviating many of the complications and problems associated with traditional contact pen plotters.

It is another object of this invention to provide an effective technique/system for applying ink to plotting media whose ink delivery rate can be varied in order to effect faster plot generation speeds and shorter plot generation times.

It is still another object of this invention to provide an effective technique/system for applying ink to plotting media which can effectively and quickly perform plot area fill-ins and gray scaling.

It is yet another object of this invention to provide an effective technique/system for applying ink to plotting media in which wearing and broadening of a contacting tip is not a factor in pen life and replacement time.

Other objects and benefits of the invention will become apparent from the detailed description which follows hereinafter when taken in conjunction with the drawing figures which accompany it.

SUMMARY

The foregoing objects have been achieved by the aerosol pen of the present invention comprising, a chamber containing liquid ink; ultrasonic vaporizing transducer means disposed within the chamber for forming ink vapor from the liquid ink; a pen body having a nozzle tip, the nozzle tip includes means for converging a stream of emitted ink vapor to a pre-established focal point, the nozzle tip being of a material which absorbs and recovers droplets of the ink vapor condensed therein and having an interior surface which is smooth and highly polished having no protrusions or irregularities whereby ink aerosol vapor resists condensing thereon; a conduit connected between the chamber and the pen body; pump means for creating a pressure within the chamber sufficient to force the ink vapor through the conduit and out the nozzle tip; interrupter means disposed adjacent the nozzle tip for intercepting a stream of the ink vapor emitting by the nozzle tip when the interrupter means is in a non-writing position and for not intercepting the stream of the ink vapor emitting by the nozzle tip when the interrupter means is in a writing position; means for moving the interrupter means between the non-writing position and the writing position; recycling means connected to the interrupter means for receiving the stream of the ink vapor emitting by the nozzle tip when the interrupter means is in the first position and for conducting absorbed ink vapor back to the chamber whereby the interrupter means acts as a valve for the stream of the ink vapor emitting by the nozzle tip; first wicking means disposed within the conduit for absorbing condensed ink vapor within the conduit, for conducting a first portion of condensed ink vapor back to the chamber by gravity, and for conducting a second portion of condensed ink vapor toward the pen body by gravity; and, second wicking means connected between the pen body and the recycling means for conducting the second portion of condensed ink vapor to the recycling means.

Preferably, third wicking means connected between the nozzle tip and the recycling means for conducting condensed ink vapor from the nozzle tip to the recycling means.

For full color making, the nozzle tip includes means for receiving, emitting, and converging multiple streams of ink vapor to a pre-established focal point.

Preferably, there is also control logic means for varying the rate at which the vaporizing means forms the ink vapor in combination with the pressure created within the chamber by the pump means whereby to adjust an emitted stream of the ink vapor.

DESCRIPTION OF THE PREFERRED EMBODIMENT:

The preferred embodiment of the present invention will now be described with respect to implementation in a pen plotter. As those skilled in the art will recognize and appreciate, the novel aspects of the invention can be readily adapted to other types of plotting, printing, and drafting devices. Accordingly, the breadth of the claims appended hereto is intended to reflect the scope and spirit of the invention being described herein and not to be limited by the use of a specific example.

Figure 1:
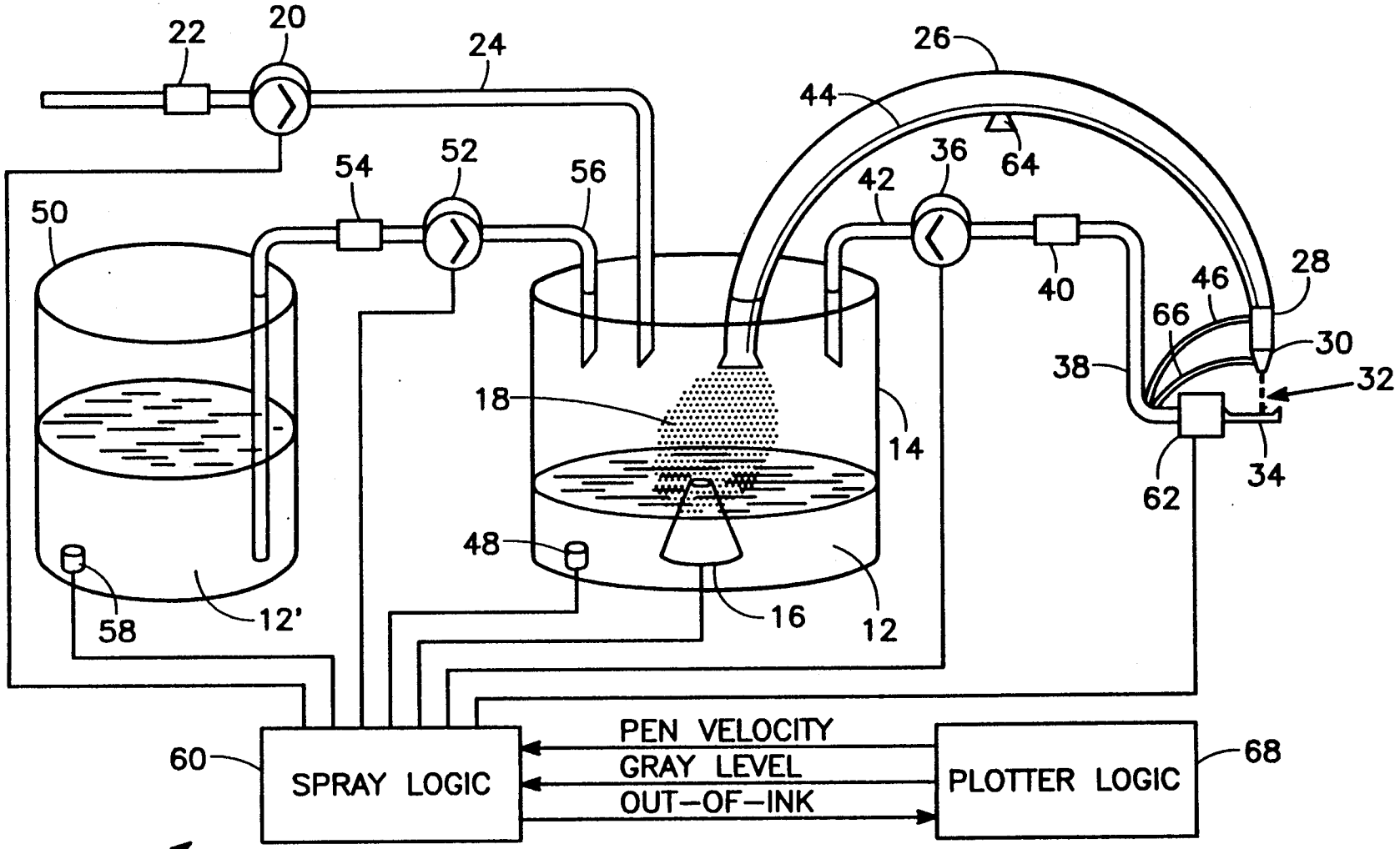
FIG. 1 is a simplified drawing of the present invention in its preferred embodiment.

A plotting system according to the present invention is shown in simplified form in FIG. 1 wherein it is generally indicated as 10. Ink 12 in chamber 14 is acted upon by ultrasonic transducer 16 to form an ink aerosol vapor 18. Fluid vaporizing ultrasonic transducers such as transducer 16 are well known in the art and generally available commercially from several sources. They are used, for example, in medical devices for vaporizing liquid medicines for inhalation and for non-steam (i.e. cool) vaporizers. The pump 20 obtains air through filter 22 and delivers it through tube 24 to chamber 14. Ink aerosol vapor 18 is forced by the resultant increased air pressure within the chamber 14 through tube 26 to pen body 28 where it is formed by a nozzle 30 into a vapor stream 32 having a preestablished focal plotting point.

When the vapor stream 32 is not being used to form an image, it impinges upon and is absorbed onto the interrupter 34. Suction pump 36 creates a partial vacuum at the interrupter 34 which removes the interrupted vapor stream 32 by tube 38 through filter 40 and returns it back to chamber 14 through tube 42.

Figure 3:
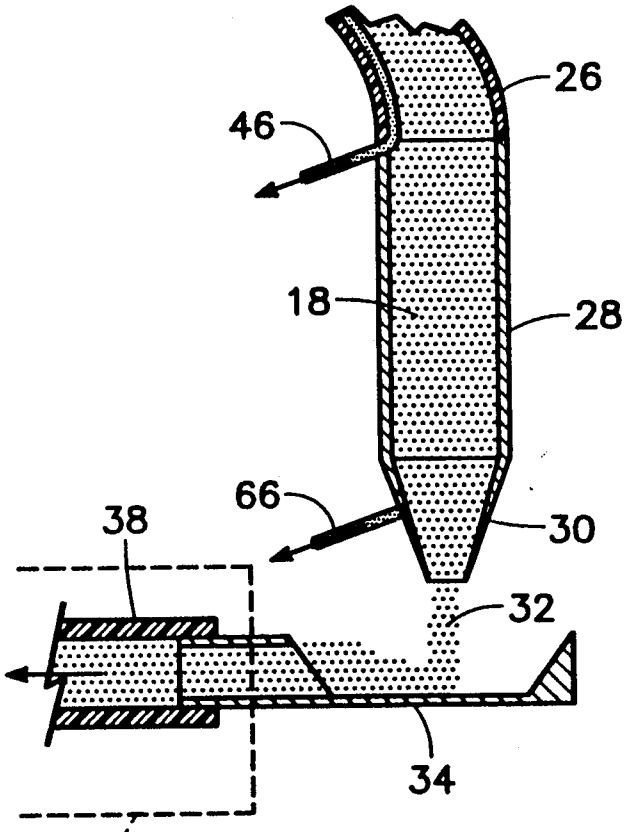
FIG. 3 is an enlarged cutaway drawing of the pen, nozzle, and interrupter of the present invention with the interrupter in an extended position which prevents lines from being drawn by and which recycles the aerosol vapor stream which is emitted by the nozzle.
Figure 2:
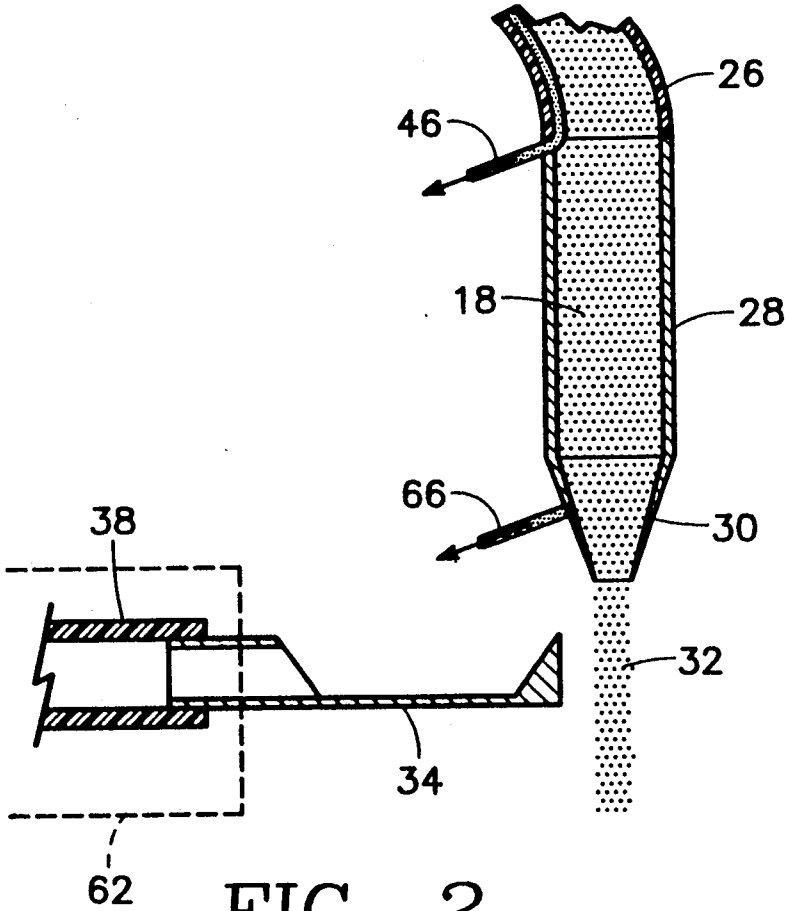
FIG. 2 is an enlarged cutaway drawing of the pen, nozzle, and interrupter of the present invention with the interrupter in a retracted position which allows lines to be drawn by the aerosol vapor stream which is emitted by the nozzle.

Any aerosol vapor condensing into ink 12 within tube 26 flows along a wick 44 by gravity, either back to chamber 14 or forward to pen body 28, depending on the location of condensation relative to tube support 64. Aerosol vapor condensation (i.e. ink 12) which flows to the pen body 28 then flows down wick 46 to tube 38. Any aerosol vapor condensation within the nozzle 30 flows down wick 66 to tube 38. These aspects are shown in greater detail in FIGS. 2 and 3 wherein the interrupter 34 is shown in its retracted (i.e. plotting) and extended (i.e. not plotting) positions.

As those skilled in the art will undoubtedly have recognized, the interrupter 34 acts in the manner of a valve with respect to the vapor stream 32. Once pressure has been created within the chamber 14 in the presence of the ink aerosol vapor 18, a vapor stream 32 is produced which cannot be simply turned on and off in the manner of raising and lowering a pen as in the prior art. This is particularly true with respect to the precision required in a pen plotter or the like. Thus, the interrupter 34 is interposed into and removed from the vapor stream 32 in a manner analogous to the pen up and down actuation employed with a physical pen. The interrupter 34 can be operated quickly with a solenoid type actuator between the two positions of FIGS. 2 and 3 to quickly and accurately turn the vapor stream 32 "on" and "off" as required for proper plotting operation. In actuality, however, it is only that portion of the vapor stream 32 which reaches the plotting media which is actually turned on and off by the interrupter 34. The produced and emitted vapor stream 32 continues at all time and is simply recycled when not being employed to create plot lines.

Returning to the overall system 10 of FIG. 1, when the sensor 48 detects that ink 12 is low, ink 12' from reservoir 50 is removed by pump 52 through filter 54 and slowly added to chamber 14 through tube 56. When the sensor 58 detects that ink 12' is low, and sensor 48 detects that ink 12 is low, an "out-of-ink" indication is reported by the spray control logic 60 to the overall plotter control logic 68 and plotting/printing is stopped until more ink is made available.

The pump 20 and ultrasonic transducer 16 are adjusted by the spray control logic 60 to provide proper amounts of aerosol ink vapor 18 and application pressure for varying pen-to-paper velocities and for grey level applications according to inputs provided by the plotter control logic 68, as indicated. Monitoring and controlling of the pumps, ink levels, and control inputs are all accomplished by the spray control logic 60. The interrupter 34 can be positioned either by modification of the normal pen up-down motion apparatus or by use of a separate actuator 62 under the direction of the spray control logic 60.

Figure 5:
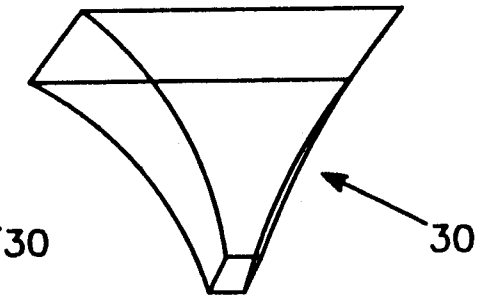
FIGS. 4–9 are simplified drawings depicting some of the aerosol pen nozzle configurations than can be employed in the present invention.
Figure 4:
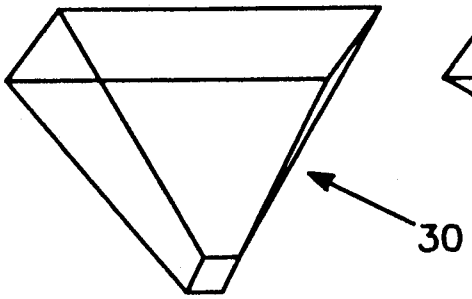
Figure 6:
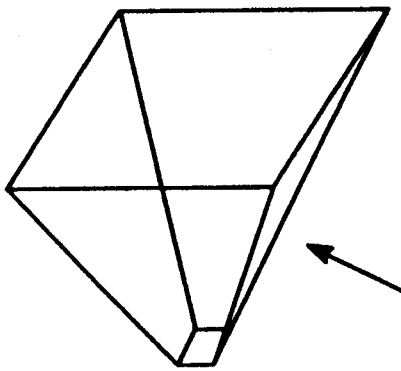
Figure 7:
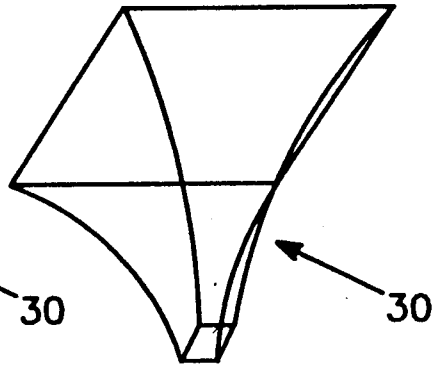
Figure 9:
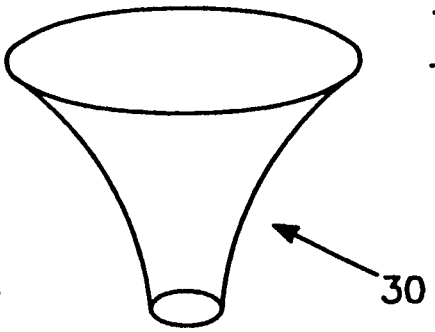
Figure 8:
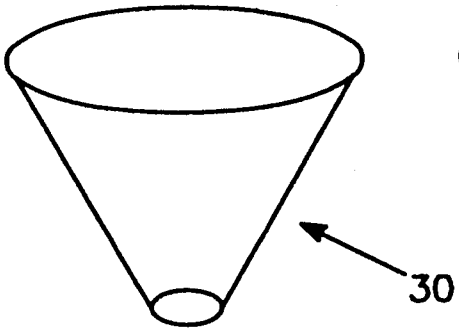

Condensation of ink aerosol vapor in the nozzle will obstruct flow. Preferably, therefore, the nozzles 30 are made of porous materials to absorb and transport liquid ink away. Actual experiments used cloth; but, forming nozzles from particle or fibers of natural, glass, metal, or plastic materials and then bonding them by pressure, heat, or adhesives should prove to be more versatile and more effective. It is anticipated that a molded ceramic material should prove to be the easiest to make and the best in operation. Note that the interior surface of the nozzle 30 must be smooth and highly polished as ink aerosol vapor tends to condense on any protrusions or irregularities. Several possible nozzle configurations anticipated are depicted in simplified form in FIGS. 4 through 9. They are, respectively, a rectangular inlet to a square outlet (FIGS. 4 and 5), a square inlet to a square outlet (FIGS. 6 and 7), and a circular inlet to a circular outlet (FIGS. 8 and 9).

Returning once again to FIG. 1, the wick 44 within tube 26 is also made of a porous material to absorb and transport condensed liquid ink that may obstruct aerosol vapor flow through tube 26. Actual experiments used thick thread; but, braided natural or synthetic fiber or braided tubing is anticipated to provide preferred results.

Figure 11:
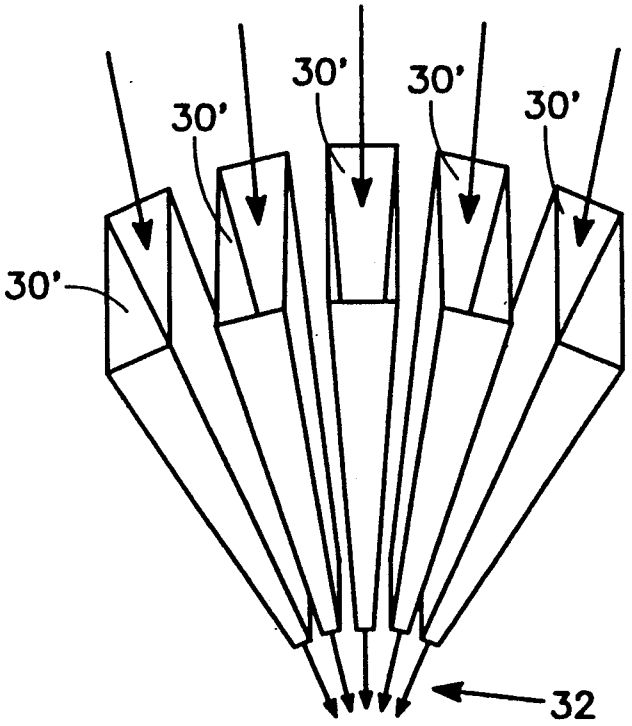
FIG. 11 is a drawing of another multiple nozzle configuration that can be employed in the present invention.
Figure 10:
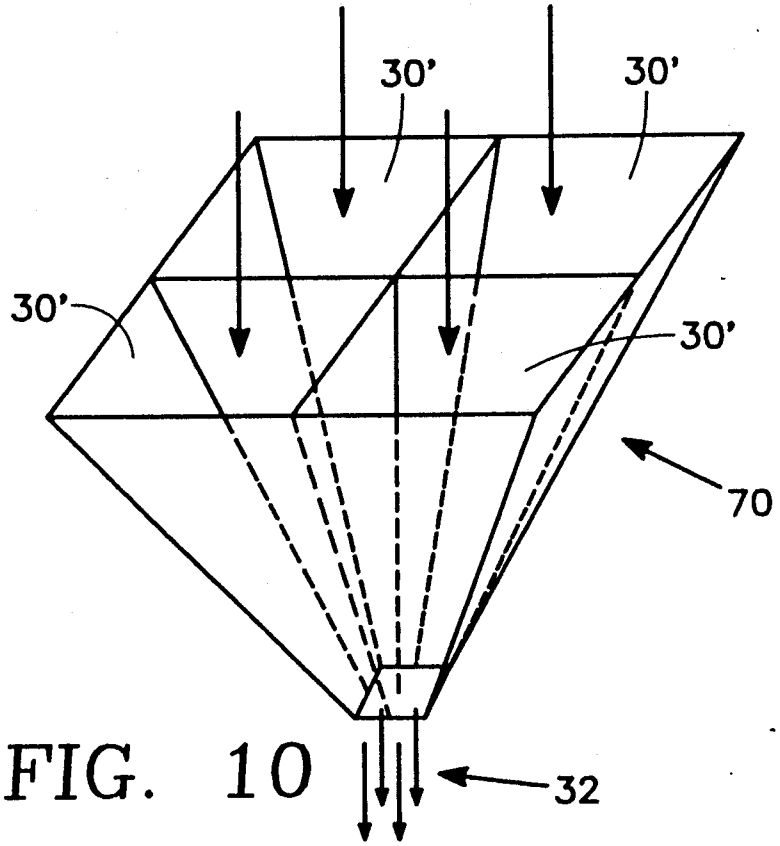
FIG. 10 is a drawing of one multiple nozzle configuration that can be employed in the present invention.

FIGS. 10 and 11 depict multiple nozzle assemblies 70 that can be employed in, for example, full color plotting. Within the multiple nozzle assemblies 70, multiple nozzles 30' are arranged to allow for the convergence of the respective ink vapor streams 32 to a pre-established focal plotting point. Of the two configurations shown, the embodiment of FIG. 11 is preferred as parallel interrupters could be employed to control the individual ink vapor streams 32.

Wherefore, having thus described the present invention,

What is claimed is:

1. In a pen plotter, aerosol pen apparatus for marking plotting media comprising:

a) a chamber containing liquid ink;

b) vaporizing means disposed within said chamber for forming ink vapor from said liquid ink;

c) a pen body having a nozzle tip;

d) a conduit connected between said chamber and said pen body;

e) pump means for creating a pressure within said chamber sufficient to force said ink vapor through said conduit and out said nozzle tip; and, f) ink vapor condensation removal means for removing condensed ink vapor from the interior of at least one of said conduit, pen body, and the nozzle tip.

2. The aerosol pen apparatus for a pen plotter of claim 1 wherein:

said vaporizing means is an ultrasonic transducer.

3. The aerosol pen apparatus for a pen plotter of claim 1 wherein the ink vapor condensation removal means comprises:

first wicking means disposed within said conduit for absorbing condensed ink vapor within said conduit and for conducting condensed ink vapor back to said chamber.

4. The aerosol pen apparatus for a pen plotter of claim 1 and additionally comprising:

a) interrupter means disposed adjacent said nozzle tip for intercepting a stream of said ink vapor emitting by said nozzle tip when said interrupter means is in a first position and for not interfering with said stream of said ink vapor emitting by said nozzle tip when said interrupter means is in a second position; and, b) means for moving said interrupter means between said first position and said second position.

5. The aerosol pen apparatus for a pen plotter of claim 4 and additionally comprising:

recycling means connected to said interrupter means for receiving said stream of said ink vapor emitting by said nozzle tip when said interrupter means is in said first position and for conducting absorbed ink vapor back to said chamber.

6. The aerosol pen apparatus for a pen plotter of claim 5 wherein said conduit has a center portion which is higher than said chamber and said pen body, and wherein the ink vapor condensation removal means comprises:

a) first wicking means disposed within said conduit for absorbing condensed ink vapor within said conduit, for conducting a first portion of said condensed ink vapor back to said chamber by gravity, and for conducting a second portion of condensed ink vapor toward said pen body by gravity; and, b) second wicking means connected between said pen body and said recycling means for conducting said second portion of condensed ink vapor to said recycling means.

7. The aerosol pen apparatus for a pen plotter of claim 6 wherein the ink vapor condensation removal means further comprises:

third wicking means connected between said nozzle tip and said recycling means for conducting condensed ink vapor from said nozzle tip to said recycling means.

8. The aerosol pen apparatus for a pen plotter of claim 1 wherein:

said nozzle tip includes means for converging a stream of emitted ink vapor to a pre-established focal point.

9. The aerosol pen apparatus for a pen plotter of claim 1 wherein:

said nozzle tip includes means for converging multiple streams of emitted ink vapor to a pre-established focal point.

10. The aerosol pen apparatus for a pen plotter of claim 1 wherein:

said nozzle tip is of a material which absorbs and recovers droplets of said ink vapor condensed therein.

11. The aerosol pen apparatus for a pen plotter of claim 1 wherein:

said nozzle tip has an interior surface which is smooth and highly polished having no protrusions or irregularities whereby ink aerosol vapor resists condensing thereon.

12. The aerosol pen apparatus for a pen plotter of claim 1 and additionally comprising:

control logic means for varying the rate at which said vaporizing means forms said ink vapor in combination with the pressure created within said chamber by said pump means whereby to adjust an emitted stream of said ink vapor.

13. Aerosol pen apparatus comprising:

a) a chamber containing liquid ink;

b) ultrasonic vaporizing transducer means disposed within said chamber for forming ink vapor from said liquid ink;

c) a pen body having a nozzle tip;

d) a conduit connected between said chamber and said pen body;

e) pressure creating means for creating a pressure within said chamber sufficient to force said ink vapor through said conduit and out said nozzle tip;

f) interrupter means disposed adjacent said nozzle tip for intercepting a steam of said ink vapor emitting by said nozzle tip when said interrupter means is in a first position and for not intercepting said stream of said ink vapor emitting by said nozzle tip when said nozzle tip when said interrupter means is in a second position;

g) means for moving said interrupter means between said first position and said second position; and, h) ink vapor condensation removal means for removing condensed ink vapor from the interior of at least one of said conduit, pen body, and nozzle tip.

14. The aerosol pen apparatus of claim 13 and additionally comprising:

recycling means connected to said interrupter means for receiving said stream of said ink vapor emitting by said nozzle tip when said interrupter means is in said first position and for conducting absorbed ink vapor back to said chamber whereby said interrupter means acts as a valve for said stream of said ink vapor emitting by said nozzle tip.

15. The aerosol pen apparatus of claim 14 wherein said conduit has a center portion which is higher than said chamber and said pen body, and wherein the ink vapor condensation removal means comprises:

a) first wicking means disposed within said conduit for absorbing condensed ink vapor within said conduit, for conducting a first portion of said condensed ink vapor back to said chamber by gravity, and for conducting a second portion of condensed ink vapor toward said pen body by gravity; and, b) second wicking means connected between said pen body and said recycling means for conducting said second portion of condensed ink vapor to said recycling means.

16. The aerosol pen apparatus of claim 15 wherein the ink vapor condensation removal means further comprises:

third wicking means connected between said nozzle tip and said recycling means for conducting condensed ink vapor from said nozzle tip to said recycling means.

17. The aerosol pen apparatus of claim 13 wherein:

said nozzle tip includes means for converging a stream of emitted ink vapor to a pre-established focal point.

18. The aerosol pen apparatus of claim 13 wherein:

said nozzle tip includes means for converging multiple streams of emitted ink vapor to a pre-established focal point.

19. The aerosol pen apparatus of claim 13 wherein:

said nozzle tip is of a material which absorbs and recovers droplets of said ink vapor condensed therein.

20. The aerosol pen apparatus of claim 13 wherein:

said nozzle tip has an interior surface which is smooth and highly polished having no protrusions or irregularities whereby ink aerosol vapor resists condensing thereon.

21. The aerosol pen apparatus of claim 13 and additionally comprising:

control logic means for varying the rate at which said vaporizing means forms said ink vapor in combination with the pressure created within said chamber by said pressure creating means whereby to adjust an emitted stream of said ink vapor.

22. An aerosol pen comprising:

a) a chamber containing liquid ink;

b) ultrasonic vaporizing transducer means disposed within said chamber for forming ink vapor from said liquid ink;

c) a pen body having a nozzle tip, said nozzle tip includes means for converging a stream of emitted ink vapor to a pre-established focal point, said nozzle tip being of a material which absorbs and recovers droplets of said ink vapor condensed therein and having an interior surface which is smooth and highly polished having no protrusions or irregularities whereby ink aerosol vapor resists condensing thereon;

d) a conduit connected between said chamber and said pen body;

e) pump means for creating a pressure within said chamber sufficient to force said ink vapor through said conduit and out said nozzle tip;

f) interrupter means disposed adjacent said nozzle tip for intercepting a stream of said ink vapor emitting by said nozzle tip when said interrupter means is in a non-writing position and for not intercepting said stream of said ink vapor emitting by said nozzle tip when said interrupter means is in a writing position;

g) means for moving said interrupter means between said non-writing position and said writing position;

h) recycling means connected to said interrupter means for receiving said stream of said ink vapor emitting by said nozzle tip when said interrupter means is in said first position and for conducting absorbed ink vapor back to said chamber whereby said interrupter means acts as a valve for said stream of said ink vapor emitting by said nozzle tip;

i) first wicking means disposed within said conduit for absorbing condensed ink vapor within said conduit, for conducting a first portion of condensed ink vapor back to said chamber by gravity, and for conducting a second portion of condensed ink vapor toward said pen body by gravity; and, j) second wicking means connected between said pen body and said recycling means for conducting said second portion of condensed ink vapor to said recycling means.

23. The aerosol pen of claim 22 and additionally comprising:

third wicking means connected between said nozzle tip and said recycling means for conducting condensed ink vapor from said nozzle tip to said recycling means.

24. The aerosol pen apparatus of claim 22 wherein:

said nozzle tip includes means for receiving, emitting, and converging multiple streams of ink vapor to a pre-established focal point.

25. The aerosol pen apparatus of claim 22 and additionally comprising:

control logic means for varying the rate at which said vaporizing means forms said ink vapor in combination with the pressure created within said chamber by said pump means whereby to adjust an emitted stream of said ink vapor.

* * * * *